US011266240B2

(12) United States Patent
Hegarty et al.

(10) Patent No.: US 11,266,240 B2
(45) Date of Patent: Mar. 8, 2022

(54) DRAWER ASSEMBLY

(71) Applicant: LIBERTY HARDWARE MFG. CORP., Winston-Salem, NC (US)

(72) Inventors: Robert Douglas Hegarty, Winston-Salem, NC (US); Gabriel Prero, Chicago, IL (US); Ethan Creasman, Raleigh, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 17/030,434

(22) Filed: Sep. 24, 2020

(65) Prior Publication Data

US 2021/0093084 A1 Apr. 1, 2021

Related U.S. Application Data

(60) Provisional application No. 62/906,151, filed on Sep. 26, 2019.

(51) Int. Cl.
*A47B 88/90* (2017.01)
*A47B 88/95* (2017.01)

(52) U.S. Cl.
CPC ..... *A47B 88/941* (2017.01); *A47B 2088/902* (2017.01); *A47B 2088/951* (2017.01); *A47B 2210/092* (2013.01); *A47B 2210/097* (2013.01)

(58) Field of Classification Search
CPC ... A47B 88/90; A47B 88/941; A47B 88/0014; A47B 88/944; A47B 88/0044; A47B 88/95; A47B 88/0051; A47B 2088/902; A47B 2088/0037; A47B 2088/951; A47B 2088/0059; A47B 2088/952; A47B 2088/0062; A47B 2088/953; A47B 2088/0066; A47B 2088/954; A47B 2088/007; A47B 2088/955; A47B 2088/0074; A47B 2210/09;
(Continued)

(56) References Cited

U.S. PATENT DOCUMENTS 3,846,003 A * 11/1974 Rockwell ..... A47B 88/90 312/204
4,191,439 A * 3/1980 Cohen ..... A47B 88/941 312/111
(Continued)

FOREIGN PATENT DOCUMENTS

AT 510724 B1 * 6/2012 ..... A47B 88/941
CN 108903401 A * 11/2018
(Continued)

*Primary Examiner* — Andrew M Roersma
(74) *Attorney, Agent, or Firm* — Brooks Kushman P.C.; Lora Graentzdoerffer

(57) ABSTRACT

A drawer assembly is provided with a bottom panel sized to receive and support articles. A rear upright panel is in cooperation with the bottom panel. A pair of spaced apart upright side panels is in cooperation with the bottom panel. A front upright panel is spaced apart from the rear upright panel, and in cooperation with the bottom panel. A series of connectors is provided at intersections of the pair of upright side panels with the rear upright panel and with the front upright panel and oriented in an upright direction to assemble the pair of upright side panels to the rear upright panel and the front upright panel by sliding in the upright direction.

17 Claims, 7 Drawing Sheets

(58) Field of Classification Search
CPC ..... A47B 2210/092; A47B 2210/097; A47B 2230/0074; A47B 2230/0081
See application file for complete search history.

(56) References Cited

U.S. PATENT DOCUMENTS

| | | | | |
|---|---|---|---|---|
| 4,909,581 | A | 3/1990 | Haheeb | |
| 4,934,765 | A | 6/1990 | Slifer, Sr. et al. | |
| 6,443,545 | B1 | 9/2002 | Woerner | |
| 8,764,137 | B2 | 7/2014 | Fehre | |
| 8,998,356 | B2 * | 4/2015 | Gasser | F16B 12/26 312/348.2 |
| 9,719,542 | B2 | 8/2017 | Cappelle et al. | |
| 10,881,204 | B2 * | 1/2021 | Chen | A47B 88/95 |
| 2009/0153006 | A1 | 6/2009 | Hazzard et al. | |
| 2018/0206636 | A1 * | 7/2018 | Held | A47B 88/956 |
| 2020/0345141 | A1 * | 11/2020 | Kampl | A47B 88/941 |

FOREIGN PATENT DOCUMENTS

| | | | | |
|---|---|---|---|---|
| DE | 102011050157 | A1 * | 11/2012 | A47B 88/956 |
| EP | 0702915 | A2 * | 3/1996 | A47B 88/956 |
| EP | 1125524 | A1 * | 8/2001 | A47B 88/941 |
| EP | 2398350 | B1 * | 9/2013 | F16B 12/46 |
| FR | 710308 | A * | 8/1931 | F16B 12/60 |
| WO | 2008150234 | A1 | 12/2008 | |
| WO | WO-2012062605 | A1 * | 5/2012 | A47B 88/956 |

* cited by examiner

DRAWER ASSEMBLY

CROSS-REFERENCE TO RELATED APPLICATIONS

This application claims the benefit of U.S. provisional application Ser. No. 62/906,151 filed Sep. 26, 2019, the disclosure of which is hereby incorporated in its entirety by reference herein.

TECHNICAL FIELD

Various embodiments relate to drawer assemblies.

BACKGROUND

Furniture drawer assemblies incur significant shipping expenses when shipped assembled. A significant cost-savings is provided to the end user by packaging a drawer assembly disassembled. A disassembled drawer assembly can be packaged relatively compact, which is often referred to as a flat-pack drawer assembly.

SUMMARY

According to an embodiment, a drawer assembly is provided with a bottom panel sized to receive and support articles. A rear upright panel is in cooperation with the bottom panel. A pair of spaced apart upright side panels is in cooperation with the bottom panel. A front upright panel is spaced apart from the rear upright panel, and in cooperation with the bottom panel. A series of connectors is provided at intersections of the pair of upright side panels with the rear upright panel and with the front upright panel and oriented in an upright direction to assemble the pair of upright side panels to the rear upright panel and the front upright panel by sliding in the upright direction.

According to a further embodiment, a first pair of connectors of the series of connectors are attached to a rear surface of the front upright panel. A second pair of connectors of the series of connectors are each attached to a forward end of one of the pair of spaced apart upright side panels for connection to the first pair of connectors.

According to an even further embodiment, a third pair of connectors of the series of connectors are each attached to a rear end of one of the pair of spaced apart upright side panels. A fourth pair of connectors of the series of connectors connect the rear upright panel to the third pair of connectors.

According to another further embodiment, a slot is formed in each of the pair of spaced apart upright side panels at a lower region to receive and support an end of the bottom panel.

According to another further embodiment, a first pair of connectors of the series of connectors, are each provided with a substrate, sidewalls extending from the substrate, and a crossbar interconnecting the sidewalls and spaced apart from the substrate to form a receptacle therein.

According to an even further embodiment, a second pair of connectors of the series of connectors, are each provided with a substrate, and a retainer clip extending from the substrate and sized to be received in the receptacle of the one of the first pair of connectors.

According to another even further embodiment, the crossbar of each of the first pair of connectors is provided with a leading edge increasing in thickness into a depth of the receptacle and terminating at an abutment edge.

According to another even further embodiment, the retainer clip of each of the second pair of connectors is provided with a leading edge that narrows into the receptacle, with an abutment edge to engage the abutment edge of the corresponding crossbar.

According to another further embodiment, the rear upright panel is further provided with a series of alternating tabs spaced linearly along a length of the rear upright panel to receive and support a portion of the bottom panel.

According to an even further embodiment, the series of alternating tabs intermittently vary in height by a thickness of the bottom panel to alternate in upper and lower support of the bottom panel.

According to another further embodiment, a first pair of connectors of the series of connectors, are each provided with a substrate, and a guide extending from the substrate.

According to an even further embodiment, the first pair of connectors are each attached to a rear end of one of the pair of spaced apart upright side panels. A pair of slots are formed through the rear upright panel each sized to receive the guide to pass therethrough. A second pair of connectors of the series of connectors are each provided with a body with a channel sized to receive the guide to connect the rear upright panel to the pair of spaced apart upright side panels.

According to another further embodiment, a second pair of connectors of the series of connectors are each provided with a body with a channel sized to receive the guide.

According to an even further embodiment, a pair of grooves are formed in the guide along a length of the guide, of each of the first pair of connectors. A pair of projections are formed within the channel to engage the pair of grooves.

According to another further embodiment, an opening is provided in an end of the body of each of the second pair of connectors to receive the corresponding guide into the channel, and another end of the channel is closed. The channel narrows from the opening to the closed end to provide an interference fit between the guide and the channel.

According to another further embodiment, a plurality of grip projections is provided externally on the body of the second pair of connectors.

According to another further embodiment, the series of connectors permit manual assembly of the drawer assembly without any additional tools.

According to another embodiment, a method for assembling a drawer assembly slides a first pair of front panel connectors into engagement with a pair of side panel connectors. A bottom panel is slid into a slot in a pair of side panels. A second pair of side panel connectors is inserted through a pair of slots through a rear panel. A pair of rear panel connectors are slid into engagement with the second pair of side panel connectors.

According to another embodiment, a drawer assembly is provided with a bottom panel sized to receive and support articles. A rear upright panel is in cooperation with the bottom panel. A pair of spaced apart upright side panels is in cooperation with the bottom panel. A front upright panel is spaced apart from the rear upright panel, in cooperation with the bottom panel. A series of connectors is provided at intersections of the pair of side upright panels with the rear upright panel and with the front upright panel and oriented in an upright direction to assemble the pair of upright side panels to the rear upright panel and the front upright panel by sliding in the upright direction. A first pair of connectors of the series of connectors are attached to a rear surface of the front upright panel. A second pair of connectors of the series of connectors are each attached to a forward end of one of the pair of spaced apart upright side panels for connection to the first pair of connectors. A third pair of connectors of the series of connectors are each attached to a rear end of one of the pair of spaced apart upright side panels. A fourth pair of connectors of the series of connectors connect the rear upright panel to the third pair of connectors. One of the pairs of connectors, are each provided with a substrate, and a guide extending from the substrate. Another of the pairs of connectors, are each provided with a body with a channel sized to receive the guide of the one of the pairs of connectors. A pair of grooves are formed in the guide along a length of the guide, of each of the first pair of connectors. A pair of projections are formed within the channel to engage the pair of grooves. An opening is provided in an end of the body of each of the second pair of connectors to receive the corresponding guide into the channel, and another end of the channel is closed. The channel narrows from the opening to the closed end to provide an interference fit between the guide and the channel.

According to a further embodiment, the rear upright panel is further provided with a series of alternating tabs spaced linearly along a length of the rear upright panel to receive and support a portion of the bottom panel. The series of alternating tabs intermittently vary in height by a thickness of the bottom panel to alternate in upper and lower support of the bottom panel.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Manual assembly of drawer assemblies by the end user is often difficult and time consuming. The assembly of the drawer assemblies is often the most difficult and time-consuming process of assembling cabinets, furniture, closet systems, and the like. Drawer assemblies often have a large quantity of components, and a typical installation often utilizes multiple drawer assemblies. Disassembled drawer assemblies often require specialty tools and significant efforts to assemble.

Figure 1:
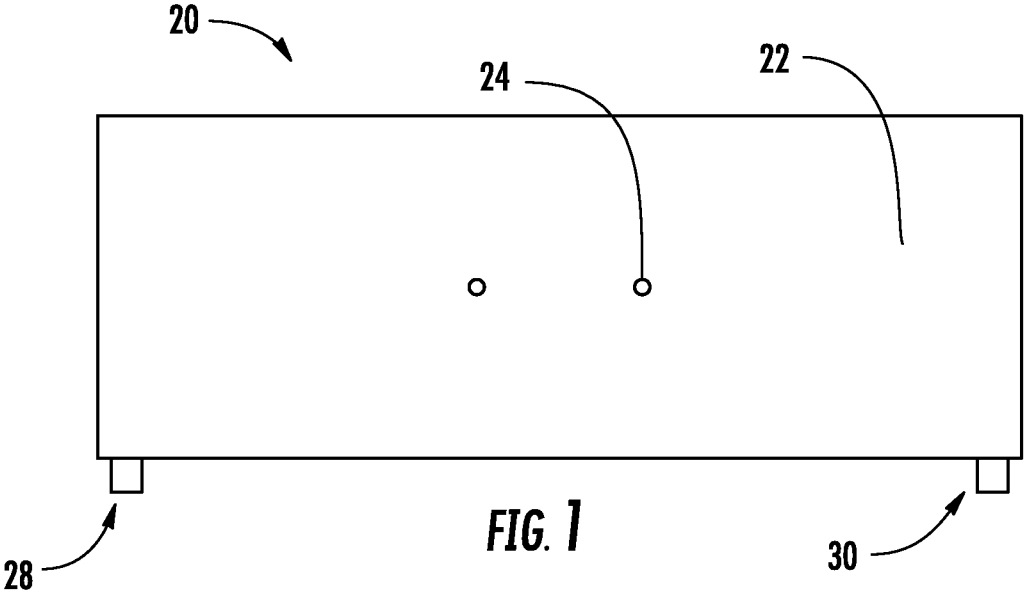
FIG. 1 is a front elevation view of a drawer assembly according to an embodiment.
Figure 2:
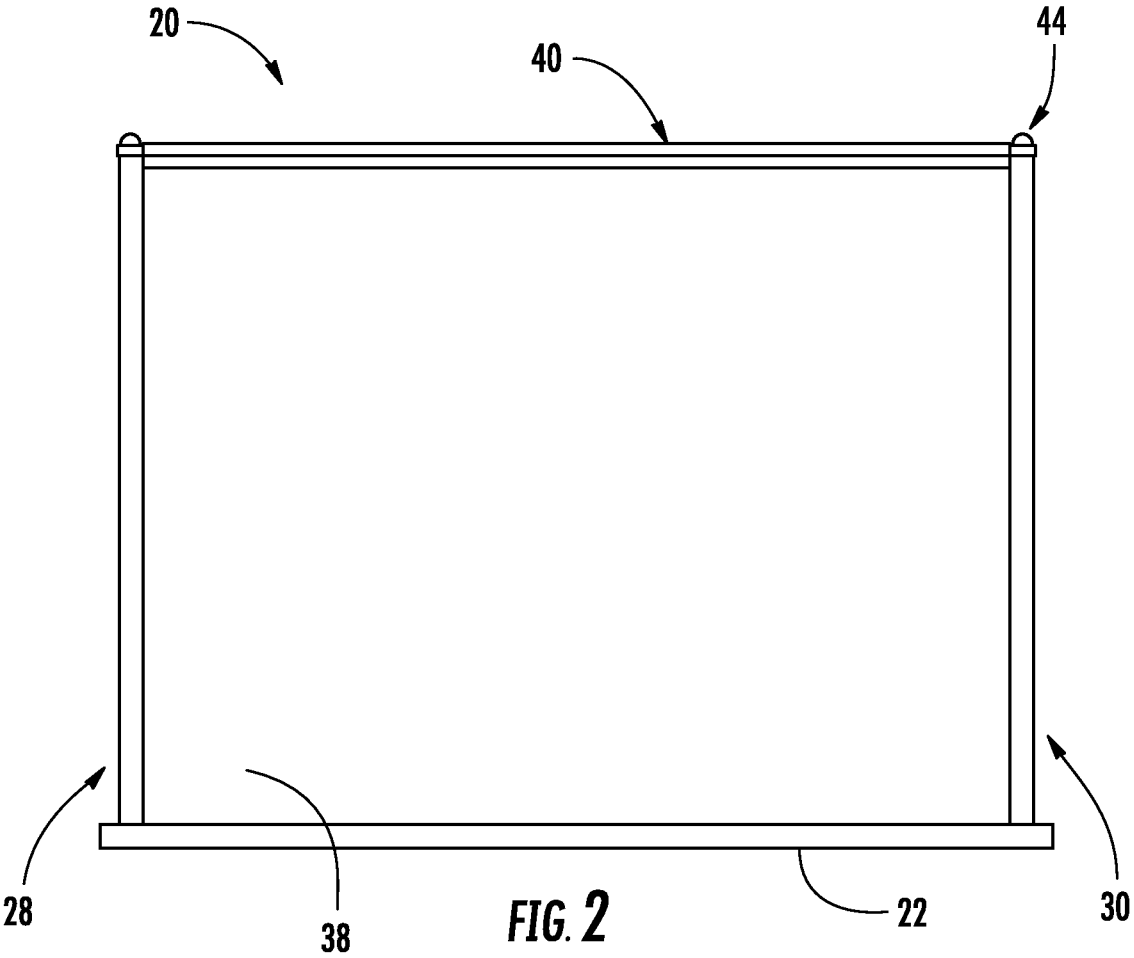
FIG. 2 is a top plan view of the drawer assembly of FIG. 1.
Figure 3:
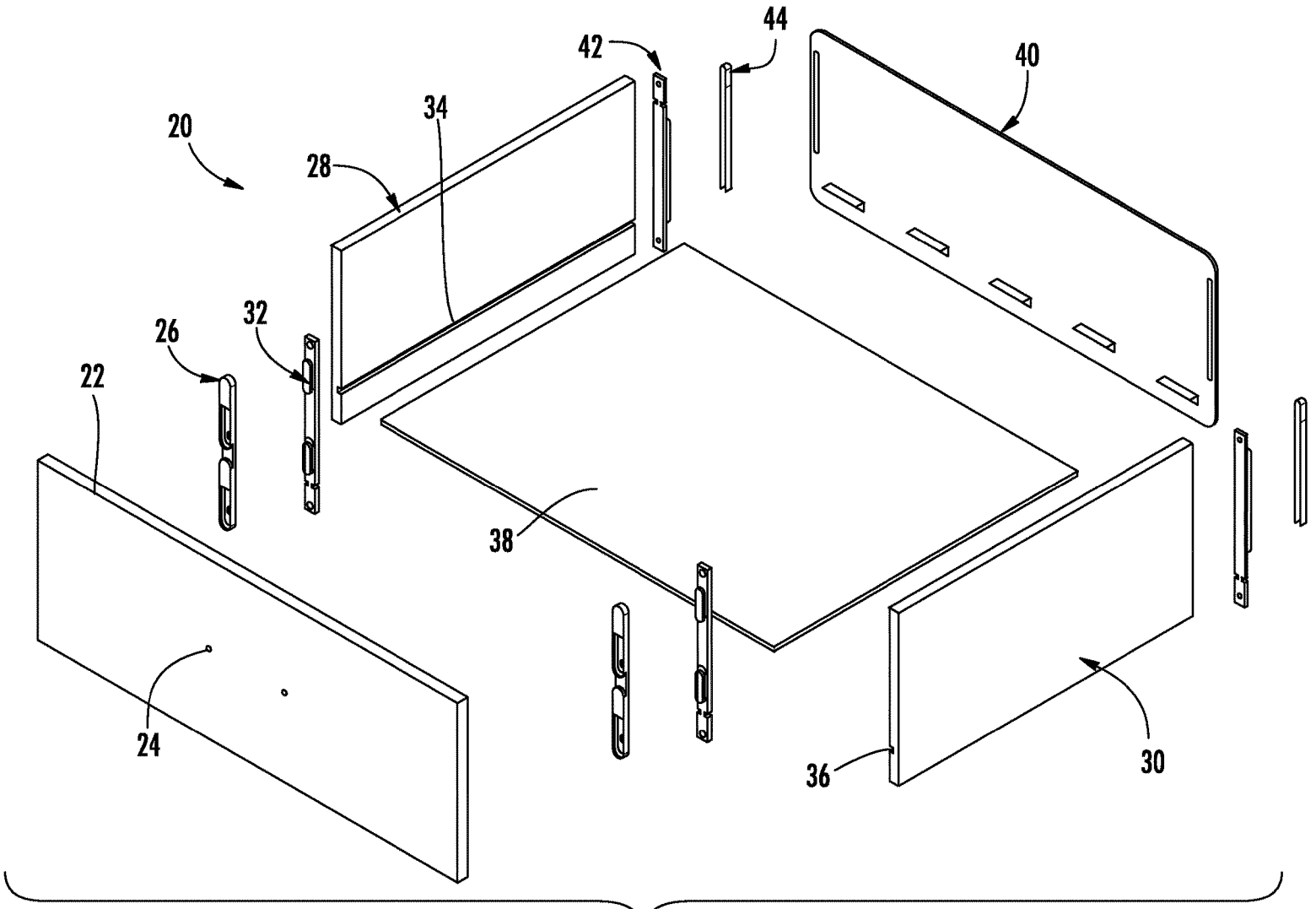
FIG. 3 is an exploded front perspective view of the drawer assembly of FIG. 1.

FIGS. 1-3 illustrate a drawer assembly 20 according to an embodiment. The drawer assembly 20 is for a standard furniture dresser, with a design that feels and performs like a standard drawer assembly. The drawer assembly can be sold and packaged unassembled, and then be assembled by the end user or consumer quickly and without the use of any additional tools, such as power tools or manual handheld tools.

The drawer assembly 20 includes a front panel 22. The front panel 22 is generally planar and rectangular and may be formed from a wood material, a wood composite, a polymer, or the like. The front panel 22 has a pair of apertures 24 for mounting a handle. A pair of fasteners or connectors 26 are fastened to a rear surface of the front panel 22. The connectors 26 may be fastened to the front panel 22 by an adhesive, nails, wood screws, or the like. Mortises can be formed in a rear surface of the front panel 22 to receive the connectors 26.

The drawer assembly 20 includes a pair of spaced apart side panels 28, 30. The side panels 28, 30 are also each planar, rectangular, and formed from a wood material, a wood composite, a polymer, or the like. A pair of connectors 32 are each fastened to a forward end of one of the side panels 28, 30. The connectors 32 are fastened to the side panels by adhesive, mechanical fasteners or the like. The front side panel connectors 32 connect to the front panel connectors 26 thereby connecting the side panels 28, 30 to the front panel 22.

Each of the side panels 28, 30 includes a slot 34, 36 formed along a length at a lower region to receive and support an end of a bottom panel 38 of the drawer assembly 20. The bottom panel 38 is planar, rectangular, and formed from a wood material, a wood composite, a polymer, a sheet metal, or the like. The bottom panel 38 is retained at the front by the front panel 22, which may also include a slot to receive an end of the bottom panel 38. The bottom panel 38 is also received and supported at a rear end by a rear panel 40.

A pair of rear side panel connectors 42 are each provided on a rear end of one of the side panels 28, 30. The rear side panel connectors 42 are fastened to the rear ends of the side panels 28, 30 by an adhesive, nail, screw or the like. A pair of rear panel connectors 44 are provided to connect the rear panel 40 to the rear side panel connectors 42.

Figure 4:
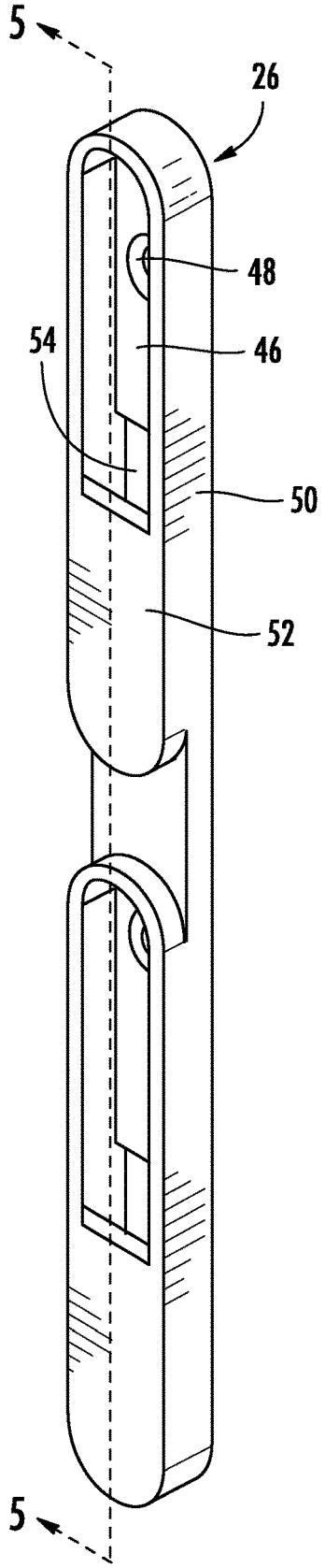
FIG. 4 is a front perspective view of a fastener of the drawer assembly of FIG. 1, according to an embodiment.
Figure 5:
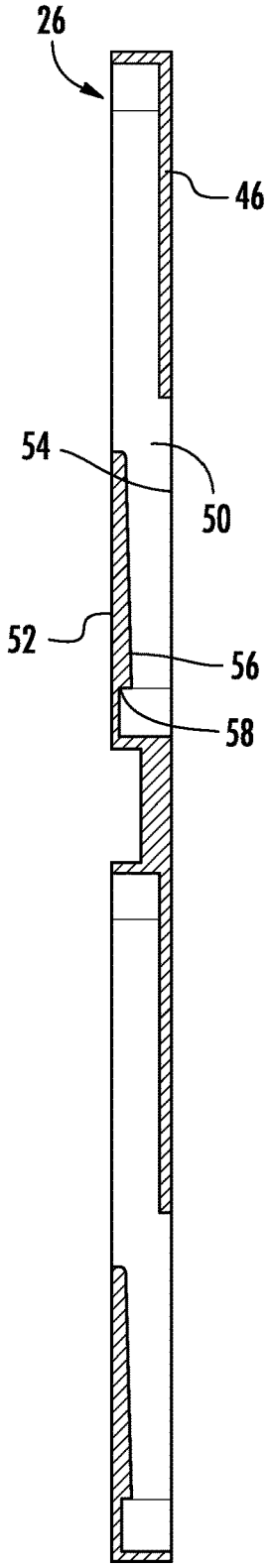
FIG. 5 is a section view of the fastener of FIG. 4, taken along section line 5-5.

With reference now to FIGS. 4 and 5, the front panel connectors 26 are illustrated enlarged and in greater detail. The front panel connectors 26 are elongate and may be formed from a suitable structural material, such as a cast metal alloy, such as a zinc alloy, a polymer, or the like. The front panel connectors 26 have a substrate 46. A pair of apertures 48 may be formed through the substrate 46 to receive fasteners to fasten the connectors 26 to the front panel 22.

Two pair of sidewalls 50 extend from the substrate 46 with a crossbar 52 interconnecting a lower region of each pair of sidewalls 50. The crossbar 52 is spaced apart from the substrate 46 to form a receptacle 54 behind the crossbar 52 and between the sidewalls 50. A leading edge 56 is provided upon each crossbar 52 with the receptacle 54 increasing in thickness into a depth of the receptacle 54 and terminating at an abutment edge 58.

Figure 6:
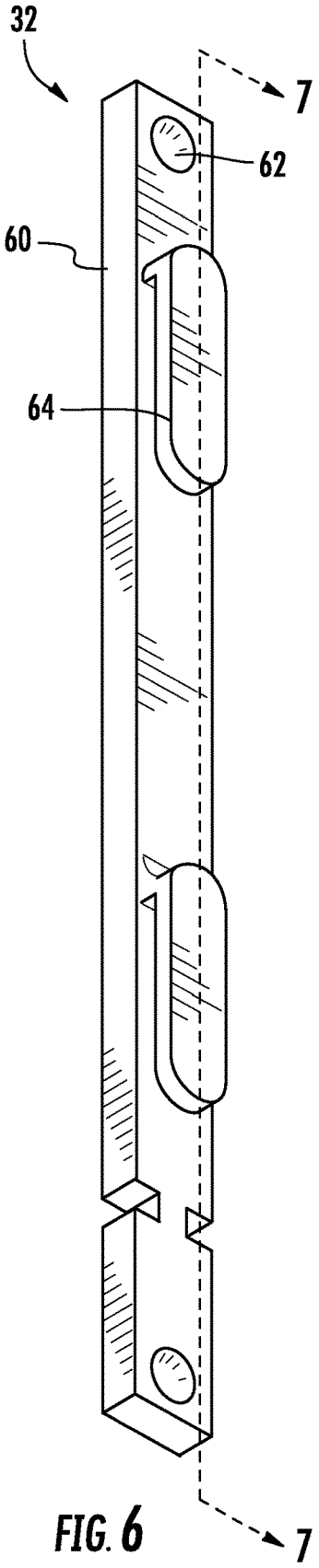
FIG. 6 is a front perspective view of a fastener of the drawer assembly of FIG. 1, according to another embodiment.
Figure 7:
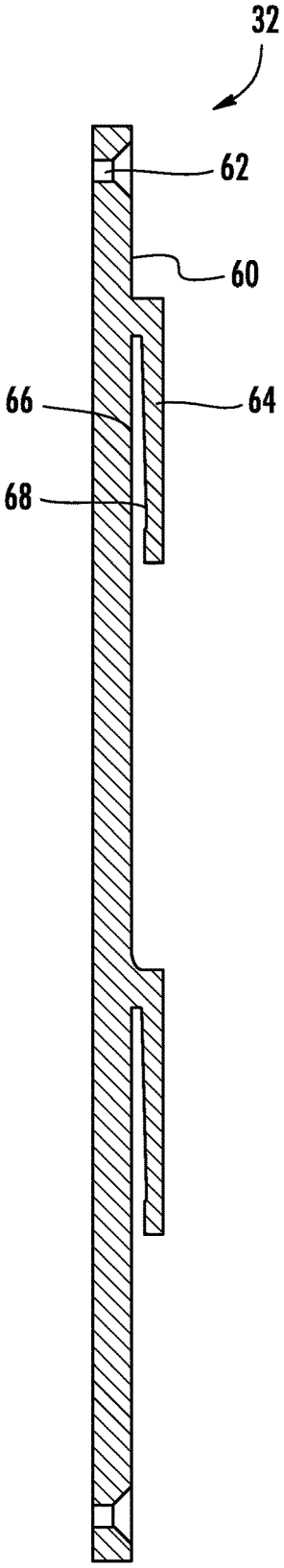
FIG. 7 is a section view of the fastener of FIG. 6, taken along section line 7-7.

FIGS. 6 and 7 illustrate the front side panel connectors 32 enlarged for greater detail. The front side panel connectors 32 are elongate and may be formed from a structural and relatively pliable polymer, such as Acrylonitrile Butadiene Styrene (ABS). The connectors 32 each include a substrate 60 with a pair of apertures 62 to receive fasteners to fasten the connectors 32 to the front ends of the side panels 28, 30.

A pair of retainer clips 64 extend from the substrate 60 and are sized to be received in the receptacles 54 of the front panel connector 26. The retainer clips 64 each include a leading edge 66 that narrows from a base of the clip 64 toward a distal end of the clip 64. An abutment edge 68 is formed adjacent the distal end of the clip 64.

During assembly, the retainer clips 64 are inserted into the receptacles 54 of the front panel connector 26. The side panels 28, 30 are moved downward thereby translating the retainer clips 64 into the receptacles 54 as the leading edges of the 56 of the receptacles 54 cause the retainer clips 64 to deform away from the front panel side connector substrate 60. Upon the abutment edges 68 of the retainer clips 64 passing the abutment edges 58 of the receptacles 54, the retainer clips 64 retract thereby engaging the retainer clip abutment edge 68 to the receptacle abutment edge 58 and locking the retainer clips 64 into the receptacles 54. Consequently, these assembly steps fasten the side panels 28, 30 to the front panel 22. These assembly steps can be performed manually without tools. The connectors 26, 32 can only be assembled in one orientation, thereby preventing incorrect assembly while expediting the assembly process.

Next, the bottom panel 38 is inserted into the slots 34, 36 in the side panels 28, 30. If the front panel 22 includes a slot, then the bottom panel 38 is also inserted into the front panel slot. This connection further prevents upward translation of the front panel 22 relative to the side panels 28, 30 and maintains the locked connection by the connectors 26, 32.

Figure 8:
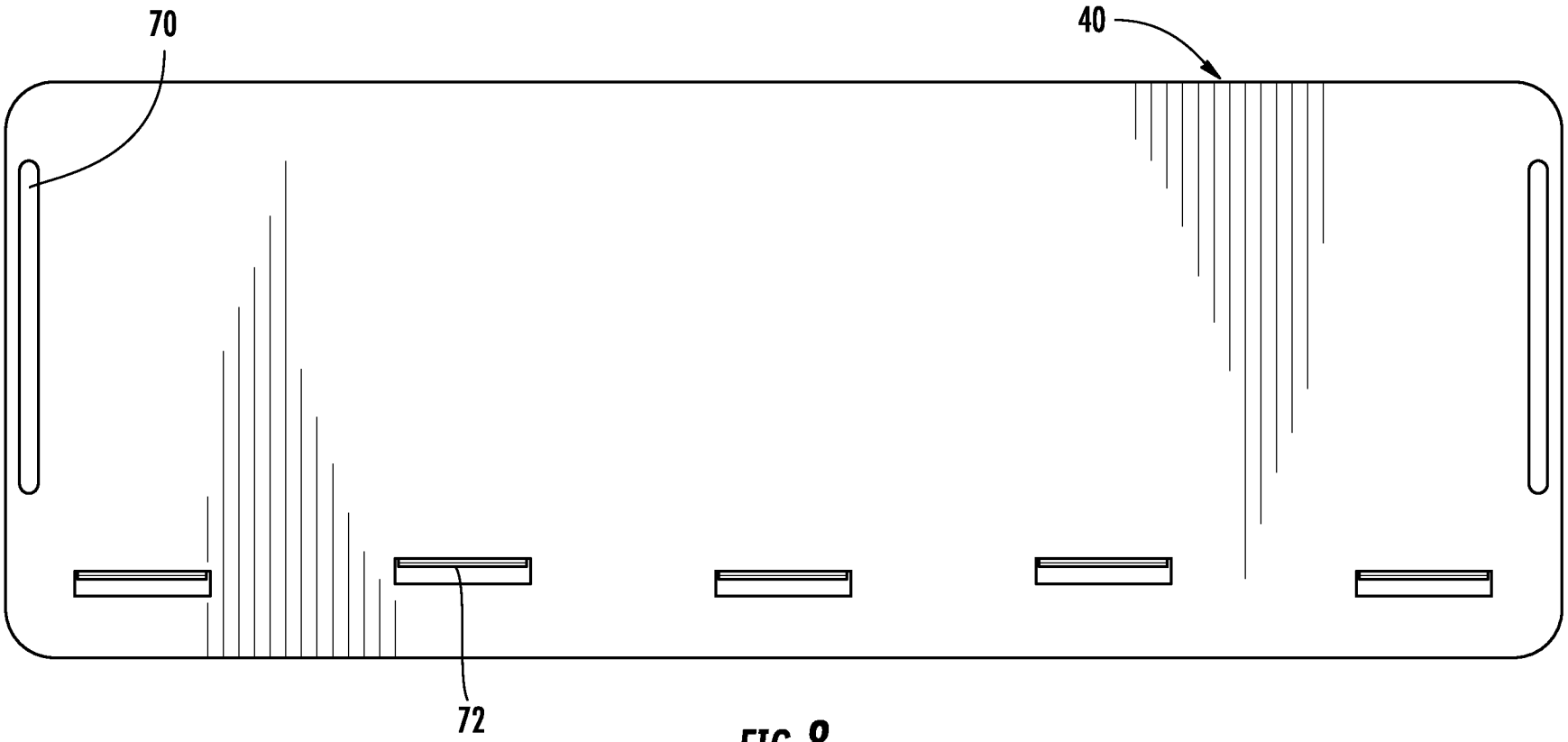
FIG. 8 is a front elevation view of a rear panel of the drawer assembly of FIG. 1.

Next, the rear panel 40 is installed upon the rear side panel connectors 42. FIG. 8 illustrates the rear panel 40 in greater detail. The rear panel 40 may be formed from any suitable material, such as sheet steel. The rear panel 40 includes a pair of slots 70 to be installed upon the rear side panel connectors 42. The rear panel 40 also includes a series of alternating tabs 72. The tabs 72 are spaced linearly along a length of the rear panel 40 to receive and support the bottom panel 38. The tabs 72 intermittently vary in height by a thickness of the bottom panel 38 to alternate in upper and lower support of the bottom panel 38.

Figure 9:
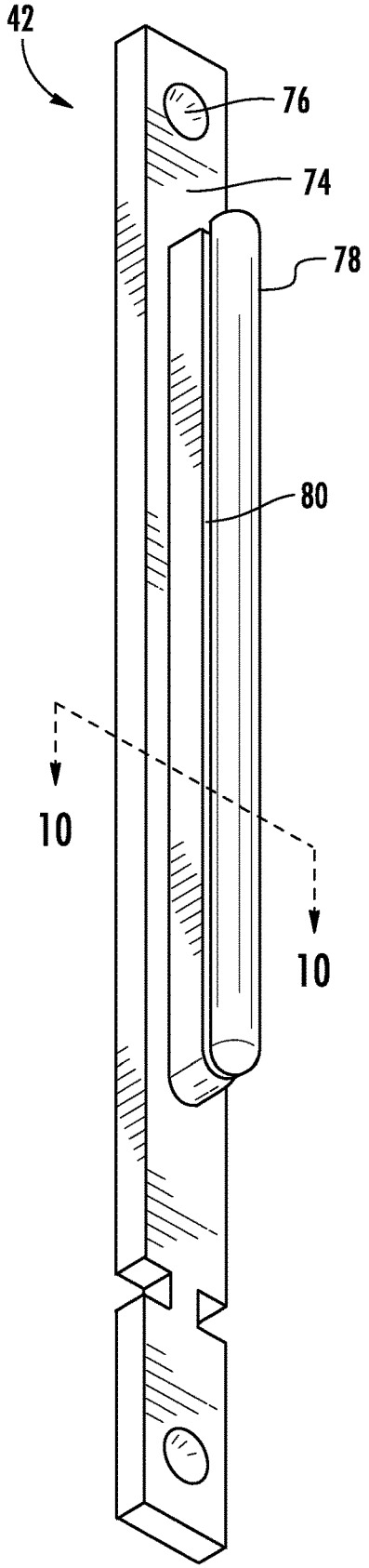
FIG. 9 is a front perspective view of a fastener of the drawer assembly of FIG. 1, according to another embodiment.
Figure 10:
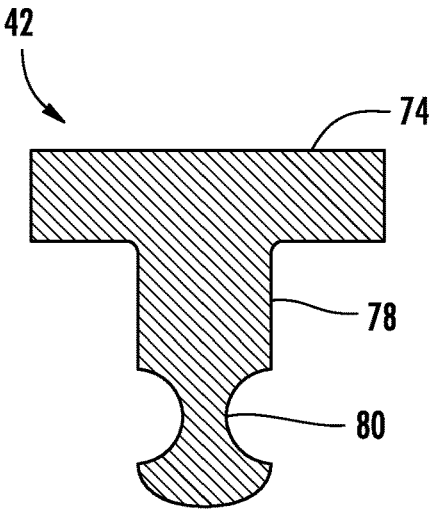
FIG. 10 is a section view of the fastener of FIG. 9, taken along section line 10-10.

FIGS. 9 and 10 illustrate one of the rear side panel connectors 42 enlarged and in greater detail. The rear side panel connectors 42 are elongate and may be formed from a cast metal alloy, such as a zinc alloy, a polymer, or the like. The rear side panel connectors 42 have a substrate 74. A pair of apertures 76 may be formed through the substrate 74 to receive fasteners to fasten the connectors 42 to the rear ends of the side panels 28, 30.

A guide 78 extends forward from the substrate 74. The slots 70 in the rear panel 40 are sized to receive the guides 78. Each guide 78 has a pair of grooves 80 formed within the guide 78 along the length of the guide 78.

Figure 11:
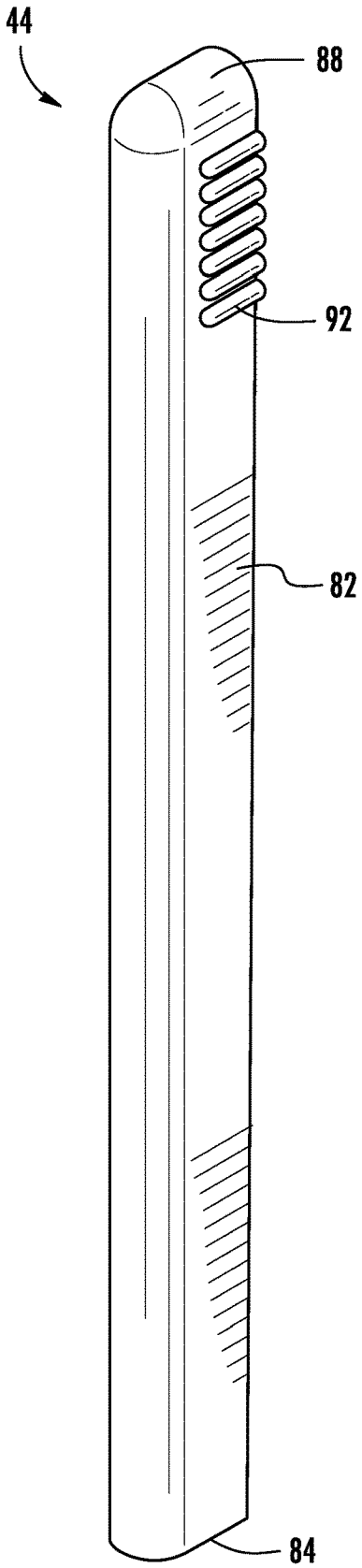
FIG. 11 is a front perspective view of a fastener of the drawer assembly of FIG. 1, according to an embodiment.
Figure 12:
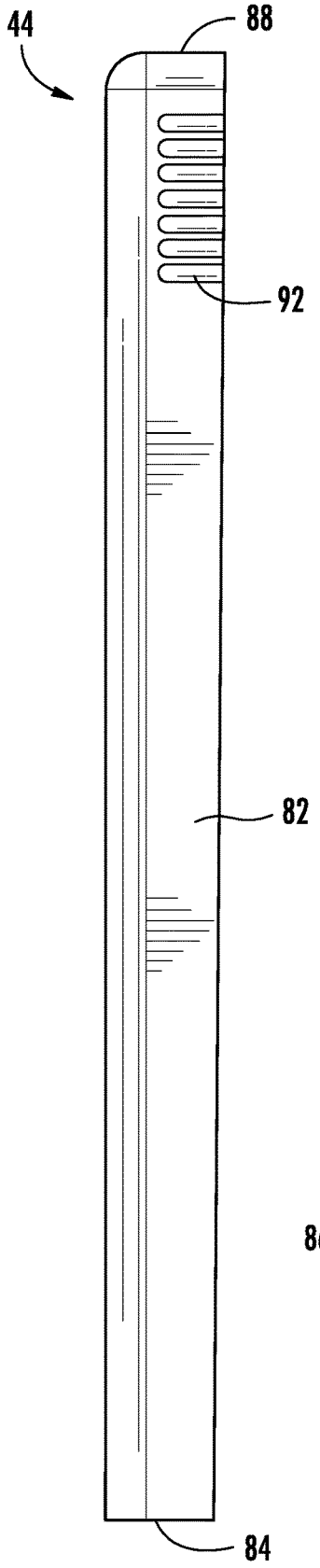
FIG. 12 is a side elevation view of the fastener of FIG. 11.
Figure 13:
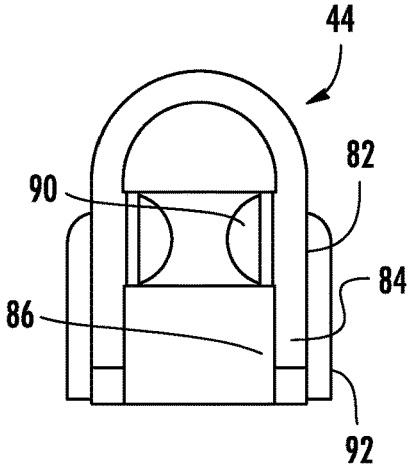
FIG. 13 is a bottom view of the fastener of FIG. 11.

The rear panel connectors 44 are illustrated in greater detail in FIGS. 11-13. The connectors 44 each have an elongate body 82 formed from a resilient and pliant material, such as a polymer like ABS. The body 82 has an opening 84 at a lower end with a channel 86 formed along the length from the opening to a closed end 88. A pair of projections 90 are formed within the channel 86 extending inward from the body 82 to engage the pair of grooves 80 in the guides 78 of the rear side panel connectors 42. The body 82 has a depth, and consequently, the channel 86 has a depth that narrows from the opening 84 to the closed end 88. Grip projections 92 extend from lateral sides of the body to be grasped by the end user.

The rear panel 40 is secured in place by installing the rear panel connectors 44 upon the rear side panel connectors 42. The narrowing depth of the rear panel connectors 44 causes a progressively increasing interference loading on the connection, thereby locking the rear panel connectors 44 upon the rear side panel connectors 42 with the rear panel therebetween. The rear panel 40 supports the rear ends of the side panels 28, 30 laterally. The bottom panel 38 in the tabs 72 of the rear panel 40 prevents the rear panel 40 from vertical movement relative to the bottom panel 38 and the side panels 28, 30.

Alternatively, the connectors 26, 32, 42, 44 may be used at any furniture panel intersection. For example, the connectors 42, 44 of FIGS. 9-12 may be employed to attach the upright side panels 28, 30 to the front panel 22. For example, the guide connectors 42 may be fastened to the front panel 22 or provided in a mortice in the front panel 22. Likewise, the channel connectors 44 may be provided along forward edges of the side panels 28, 30 or provided in mortices on the forward edges.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A drawer assembly comprising:

a bottom panel sized to receive and support articles;

a rear upright panel in cooperation with the bottom panel;

a pair of spaced apart upright side panels in cooperation with the bottom panel;

a front upright panel spaced apart from the rear upright panel, in cooperation with the bottom panel; and a series of connectors provided at intersections of the pair of upright side panels with the rear upright panel and with the front upright panel and oriented in an upright direction to assemble the pair of upright side panels to the rear upright panel and the front upright panel by sliding in the upright direction;

wherein a first pair of connectors of the series of connectors, each comprises:

a substrate provided to the series of connectors, sidewalls extending from the substrate, and a crossbar interconnecting the sidewalls and spaced apart from the substrate to form a receptacle therein;

wherein a second pair of connectors of the series of connectors, each comprises:

a substrate, and a retainer clip extending from the substrate and sized to be received in the receptacle of the one of the first pair of connectors; and wherein the crossbar is provided with a leading edge increasing in thickness into a depth of the receptacle and terminating at an abutment edge.

2. The drawer assembly of claim 1 wherein the first pair of connectors of the series of connectors are attached to a rear surface of the front upright panel; and wherein the second pair of connectors of the series of connectors are each attached to a forward end of one of the pair of spaced apart upright side panels for connection to the first pair of connectors.

3. The drawer assembly of claim 2 wherein a third pair of connectors of the series of connectors are each attached to a rear end of one of the pair of spaced apart upright side panels; and wherein a fourth pair of connectors of the series of connectors connect the rear upright panel to the third pair of connectors.

4. The drawer assembly of claim 1 wherein a slot is formed in each of the pair of spaced apart upright side panels at a lower region to receive and support an end of the bottom panel.

5. The drawer assembly of claim 1 wherein the retainer clip of each of the second pair of connectors is provided with a leading edge that narrows into the receptacle, with an abutment edge to engage the abutment edge of the corresponding crossbar.

6. The drawer assembly of claim 1 wherein the rear upright panel further comprises a series of alternating tabs spaced linearly along a length of the rear upright panel to receive and support a portion of the bottom panel.

7. The drawer assembly of claim 6 wherein the series of alternating tabs intermittently vary in height by a thickness of the bottom panel to alternate in upper and lower support of the bottom panel.

8. The drawer assembly of claim 1 wherein the first pair of connectors are further defined as a first pair of front panel connectors;

wherein a first pair of rear panel connectors of the series of connectors, each comprises:

a substrate; and a guide extending from the substrate.

9. The drawer assembly of claim 8 wherein the first pair of rear panel connectors are each attached to a rear end of one of the pair of spaced apart upright side panels;

wherein a pair of slots are formed through the rear upright panel each sized to receive the guide to pass therethrough; and wherein a second pair of rear panel connectors of the series of connectors each comprises a body with a channel sized to receive the guide to connect the rear upright panel to the pair of spaced apart upright side panels.

10. The drawer assembly of claim 8 wherein a second pair of rear panel connectors of the series of connectors each comprises a body with a channel sized to receive the guide.

11. The drawer assembly of claim 10 wherein a pair of grooves are formed in the guide along a length of the guide, of each of the first pair of rear panel connectors; and wherein a pair of projections are formed within the channel to engage the pair of grooves.

12. The drawer assembly of claim 10 wherein an opening is provided in an end of each of the channels to receive the corresponding guide into the channel, and another end of the channel is closed; and wherein the channel narrows from the opening to the closed end to provide an interference fit between the guide and the channel.

13. The drawer assembly of claim 10 wherein a plurality of grip projections is provided externally on the body of the second pair of rear panel connectors.

14. The drawer assembly of claim 1 wherein the series of connectors permit manual assembly of the drawer assembly without any additional tools.

15. The drawer assembly of claim 14, wherein the first pair of connectors is preinstalled to a rear end of the upright side panels; and wherein the second pair of connectors is preinstalled to a front side of the upright side panels.

16. A drawer assembly comprising:

a bottom panel sized to receive and support articles;

a rear upright panel in cooperation with the bottom panel;

a pair of spaced apart upright side panels in cooperation with the bottom panel;

a front upright panel spaced apart from the rear upright panel, in cooperation with the bottom panel; and a series of connectors provided at intersections of the pair of upright side panels with the rear upright panel and with the front upright panel and oriented in an upright direction to assemble the pair of upright side panels to the rear upright panel and the front upright panel by sliding in the upright direction;

wherein a first pair of connectors of the series of connectors, each comprises:

a substrate, and a guide extending from the substrate;

wherein the first pair of connectors are each attached to a rear end of one of the pair of spaced apart upright side panels;

wherein a pair of slots are formed through the rear upright panel each sized to receive the guide to pass therethrough; and wherein a second pair of connectors of the series of connectors each comprises a body with a channel sized to receive the guide to connect the rear upright panel to the pair of spaced apart upright side panels.

17. A drawer assembly comprising:

a bottom panel sized to receive and support articles;

a rear upright panel in cooperation with the bottom panel;

a pair of spaced apart upright side panels in cooperation with the bottom panel;

a front upright panel spaced apart from the rear upright panel, in cooperation with the bottom panel;

a series of connectors provided at intersections of the pair of upright side panels with the rear upright panel and with the front upright panel and oriented in an upright direction to assemble the pair of upright side panels to the rear upright panel and the front upright panel by sliding in the upright direction;

wherein a first pair of connectors of the series of connectors, each comprises:

a substrate, and a guide extending from the substrate;

wherein a second pair of connectors of the series of connectors each comprises a body with a channel sized to receive the guide;

wherein a plurality of grip projections is provided externally on the body of the second pair of connectors; and wherein slots are provided on an interior portion of the rear panel to receive the guides of the first pair of connectors so that an end user can hold the plurality of grip projections and slide the second pair of connectors to receive the guide of each of the first pair of connectors into the channel of each of the second pair of connectors to connect the rear upright panel to the pair of spaced apart upright side panels.

* * * * *